United States Patent [19]

Craven et al.

[11] 4,187,822

[45] Feb. 12, 1980

[54] LIQUID FUEL PUMPING APPARATUS

[75] Inventors: John Craven; Thomas H. M. Reilly, both of London, England

[73] Assignee: Lucas Industries Limited, Birmingham, England

[21] Appl. No.: 876,940

[22] Filed: Feb. 10, 1978

[30] Foreign Application Priority Data

Nov. 25, 1977 [GB] United Kingdom ..... 49084/77

[51] Int. Cl.[2] ..... F02N 17/00; F02M 39/00

[52] U.S. Cl. ..... 123/179 L; 123/179 G; 123/139 ST; 123/139 AQ

[58] Field of Search ..... 123/179 L, 179 G, 139 ST, 123/139 AQ, 32 EG

[56] References Cited

U.S. PATENT DOCUMENTS 2,965,092 12/1960 De Claire, Jr. ..... 123/179 L 4,074,667 2/1978 Skinner ..... 123/139 AQ

FOREIGN PATENT DOCUMENTS 2053883 11/1970 Fed. Rep. of Germany ..... 123/179 L 1394178 5/1975 United Kingdom ..... 123/139 AQ

*Primary Examiner*—Charles J. Myhre

*Assistant Examiner*—M. Moy

[57] ABSTRACT

A fuel pumping apparatus for supplying fuel to an internal combustion engine includes an adjustable throttle movable against the action of resilient means by means responsive to the speed of operation of the associated engine to which fuel is being supplied. Movement of the throttle against the action of the resilient means reduces the rate of fuel supplied to the engine and temperature responsive means is provided to adjust the throttle to increase the rate of fuel supplied to the engine when the engine is cold.

6 Claims, 3 Drawing Figures

LIQUID FUEL PUMPING APPARATUS

This invention relates to liquid fuel pumping apparatus for supplying fuel to an internal combustion engine and of the kind comprising an injection pump operable in use, in timed relationship with the associated engine, a feed pump for supplying fuel under pressure to the injection pump, an adjustable throttle for varying the rate of fuel supply to the injection pump, speed responsive means operable at low engine speeds to move said throttle to reduce the rate of fuel supply to the engine as the engine speed increases, and resilient means acting in opposition to said speed responsive means.

The amount of fuel which must be supplied to an engine when it is operating at idling speeds depends upon the operating temperature of the engine. When the engine is cold it has been found that more fuel is required to achieve satisfactory idling. If, therefore, the speed responsive means and the resilient means are adjusted so that the correct rate of fuel supply obtains when the engine is hot, then the engine will not idle correctly when it is cold and vice versa.

The object of the invention is to provide an apparatus of the kind specified in a simple and convenient form.

According to the invention, in an apparatus of the kind specified, temperature responsive means is provided to adjust the setting of said throttle whereby when the engine is cold the throttle is set to provide an increased rate of fuel supply to the engine than when the engine is hot, for a given force exerted by said resilient means.

An example of an apparatus in accordance with the invention will now be described with reference to the accompanying drawings in which.

Figure 1:
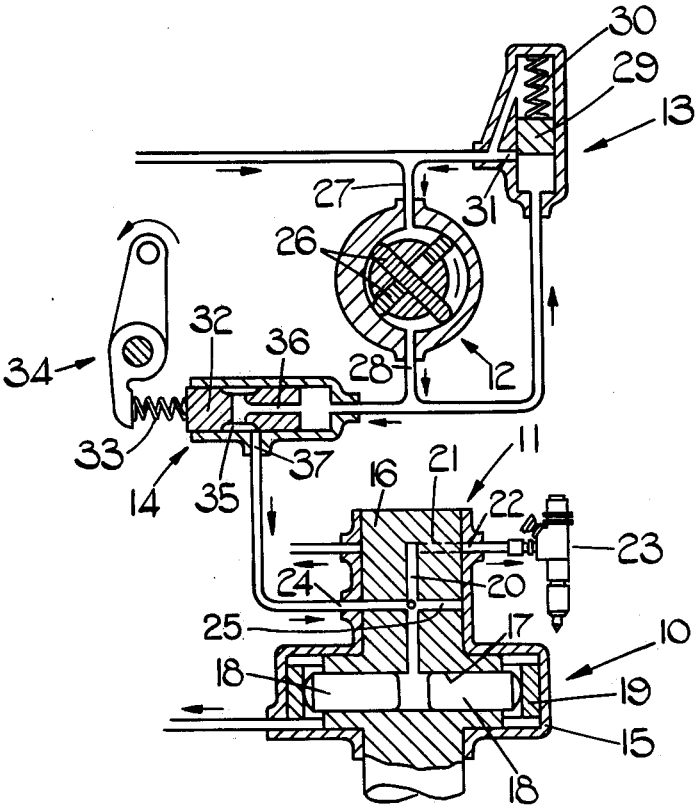
FIG. 1 is a diagrammatic representation of a known form of the apparatus.

With reference to FIG. 1 of the drawings, the apparatus comprises an injection pump 10 a rotary distributor 11, a feed pump 12, a regulating valve 13 and a throttle and governor assembly 14.

The injection pump, distributor and feed pump are contained in a common housing which is generally indicated at 15, the distributor comprising a distributor member 16 which is mounted for rotation within the housing 15 and which in use, is driven in timed relationship with the associated engine. An enlarged portion of the distributor member is provided with a transverse bore 17 which accommodates a pair of pumping plungers 18 which are moved inwardly as the distributor member rotates, by cam lobes formed on the internal peripheral surface of an annular cam ring 19 which is located within the housing. The injection pump is constituted by the cam ring 19 and the plungers 18.

The fuel delivered by the injection pump during the injection strokes, is supplied to a longitudinal passage 20 formed in the distributor member and which at its end remote from the pumping chamber of the injection pump, communicates with a delivery passage shown in dotted outline and referenced 21. The delivery passage registers in turn as the distributor member rotates, with a plurality of outlets 22 formed in the housing and which, in use, are connected to injectors 23 respectively (only one of which is shown), mounted on the associated engine.

Fuel is supplied to the injection pump along part of the aforesaid passage 20 by way of an inlet port 24 formed in the housing and communicating in turn with inlet passages 25 which communicate with the passage 20.

Fuel is supplied to the inlet port 24 by the feed pump 12 which is of the constant displacement type and as shown comprises two vanes 26 carried by the distributor member and co-operating at their outer ends, with the internal peripheral surface of a pumping chamber which is eccentrically disposed relative to the axis of rotation of the distributor member. The chamber has an inlet 27 which is connected to a source of fuel and an outlet 28 which communicates with the inlet port 24 by way of the throttle which forms part of the throttle and governor assembly 14.

The outlet pressure of the feed pump is controlled by the regulating valve 13. The method of control is to spill a portion of the fuel pumped by the pump from the outlet thereof to the inlet. The regulating valve comprises a cylinder in which is located a plunger 29 exposed at one end to the outlet pressure of the feed pump and engaging a coiled spring 30. The plunger is arranged to uncover to a greater or lesser extent, a port 31 formed in the wall of the cylinder and which communicates with the inlet of the feed pump. Moreover, the portion of the cylinder which contains the spring 30 also communicates with the inlet of the feed pump. The dimensions of the feed pump are such that it always supplies more fuel than is required to be supplied to the engine and as the speed at which the distributor member is driven increases, more fuel will need to be spilled between the outlet and inlet. As a result, the plunger 29 must be moved against the action of the spring 30 to open the port 31. Such movement requires an increasing force and as a result the outlet pressure of the feed pump increases as the speed of operation of the associated engine increases.

The throttle and governor assembly 14 comprises a piston 32 which at one end, is subjected to the outlet pressure of the feed pump and which at its other end is contacted by a spring 33 the force exerted by which can be adjusted by manually operable means generally indicated at 34.

The piston 32 is provided with a peripheral groove 35 which is in constant communication with the outlet 28 of the feed pump by way of a passage 36 formed in the piston and formed in the wall of the cylinder in which the piston 32 is mounted, is a port 37 which is in constant communication with the aforesaid inlet port 24. The disposition of the groove 35 and the port 37 is such that as the outlet pressure of the feed pump increases, indicative of an increased engine speed, the piston is moved to reduce the extent of communication between the groove 35 and the port 37. These two components constitute the throttle and with increasing speed for a given setting of the manually operable means 34, the restriction offered by the throttle increases so that the rate of fuel supple to the associated engine decreases. If for a given engine speed the manually operable means 34 is moved to increase the force exerted by the spring 33, then the degree of restriction offered by the throttle will decrease and therefore the rate of fuel supply to the engine will be increased. Similarly, if the manually operable means is moved to reduce the force exerted by the spring 33, the piston will move under the action of the outlet pressure of the feed pump and the degree of restriction offered by the throttle will increase thereby reducing the rate of fuel supply to the engine.

The throttle and governor assembly 14 described above provide what is termed "all speed" governing. It is well known, however, that special spring is required to achieve satisfactory operation of the engine at idling speeds and in addition, there is another governor arrangement known as a "two-speed" governor which effectively controls engine idling speed and engine maximum speed only.

Figure 2:
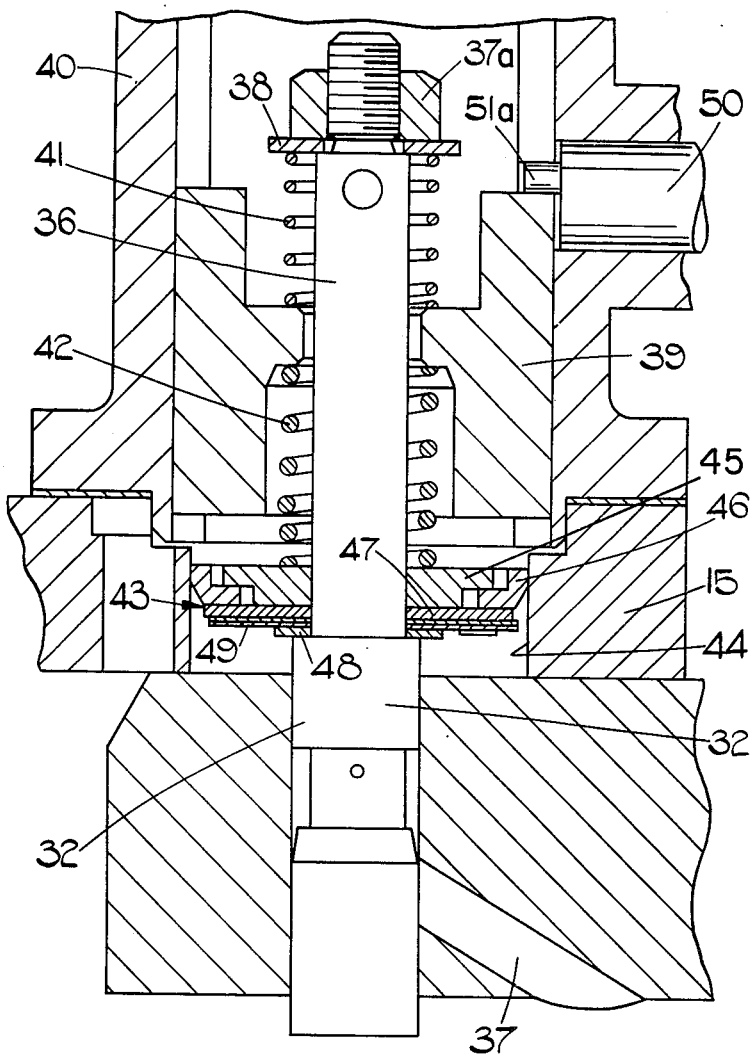
FIG. 2 shows in sectional side elevation, a portion of the apparatus shown in FIG. 1, and, FIG. 3 is a view similar to FIG. 2, showing an alternative form of the part of the apparatus which is seen in FIG. 2.

With reference to FIG. 2 of the drawings, the part of the apparatus shown herein is the practical arrangement of the throttle and governor assembly 14 shown in FIG. 1. This, as will be appreciated, being an "all speed" governor.

The piston 32 is provided with a stem 36 which at its end remote from the piston, is provided with a screwthread and is engaged by a nut 37*a* which retains a spring abutment 38 in engagement with a step defined on the stem.

Surrounding the stem is an adjustable abutment 39 which is guided for movement in a housing part 40 which is secured to the main housing 15 of the apparatus.

At its opposite ends the abutment 39 is provided with recesses having end walls. Located between the upper end wall and the abutment 38 is a coiled compression spring 41. The end wall of the other recess is engaged by a further coiled compression spring 42 and the other end of this spring bears against a dash-pot piston 43 slidable within a bore 44 defined in the housing 15. The dashpot piston comprises inner and outer annular plates 45,46 respectively. The outer peripheral surface of the inner plate and the inner peripheral surface of the outer plate, are stepped to permit relative misalignment of the bore 44 and the cylinder which contains the piston 32. A support plate 47 is located beneath the dashpot piston and a further support plate 48 is provided which bears against a step defined on the piston at its junction with the stem 36. Intermediate the support plates 47, 48 is an annular bimetallic member 49.

The axial setting of the abutment 39 is determined by the angular position of an operator adjustable member 50 which is angularly movable about an axis at right angles to the axis of movement of the piston 32. The member 50 mounts at its inner end a pin 51*a*, the pin being offset from the longitudinal axis of the member 50. As the member 50 is rotated therefore, the pin imparts downward movement to the abutment 39.

As shown in FIG. 2 of the drawings, the pin 51*a* is at its uppermost position and the outlet pressure of the feed pump acting on the piston 32, forces the abutment 39 through the intermediary of the spring 42, uupwardly into contact with the pin 51*a*. As shown, therefore, the apparatus is set to provide the minimum rate of fuel supply to the engine so that the engine is idling. The spring 42 is stronger than the spring 41 but the two springs work in opposition to each other so that the force which is acting downwardly to oppose the movement of the piston 32 by the outlet pressure of the feed pump, is the force exerted by the spring 42 less the force exerted by the spring 41. The effective force is therefore comparatively small and the control of the fuel supply to the engine will be achieved with the necessary precision required at engine idling.

If the member 50 is rotated then the pin 51 will move the abutment 39 downwardly. This will increase the force exerted by the spring 42 and will in fact reduce the force exerted by the spring 41. The piston 32 will therefore be moved downwardly and the rate of fuel supply to the engine will be increased. Reverting now to the idling situation, it has been found that the ability of the engine to idle properly depends upon its temperature and it has been found that when the engine is cold more fuel is required. The bimetal member 49 provides the necessary temperature compensation. As shown in FIG. 2, the member 49 is substantially flat. The member 49 is of course sensitive to the temperature in the housing of the apparatus and since the apparatus itself is mounted on the engine structure, it will be responsive to the temperature of the engine. The force exerted by the fuel pressure acts through the intermediary of the bimetal member 49 and above idling speed the bimetal member 49 is flattened to the position shown irrespective of the temperature. At idling speed, however, and when the temperature is low, the member 49 bows so that the piston 32 is moved downwardly a limited extent. Such downward movement of the piston 32 reduces the degree of restriction offered by the throttle constituted by the groove 35 and the port 37. As a result, when the engine is cold there will be an increase in the rate at which fuel is supplied to the engine. When the engine heats up and this heat is transmitted to the housing of the pump, the bimetal member will also heat and become flat even at idling speeds, as is shown in FIG. 2. As mentioned above, even if the engine is cold, then if the engine speed is above idling speed the member 49 will also be flat.

The dashpot piston 43 co-operates with the bore 44 to damp the movement of the piston 32 owing to engine vibration. It also acts to damp the action of the governor.

Figure 3:
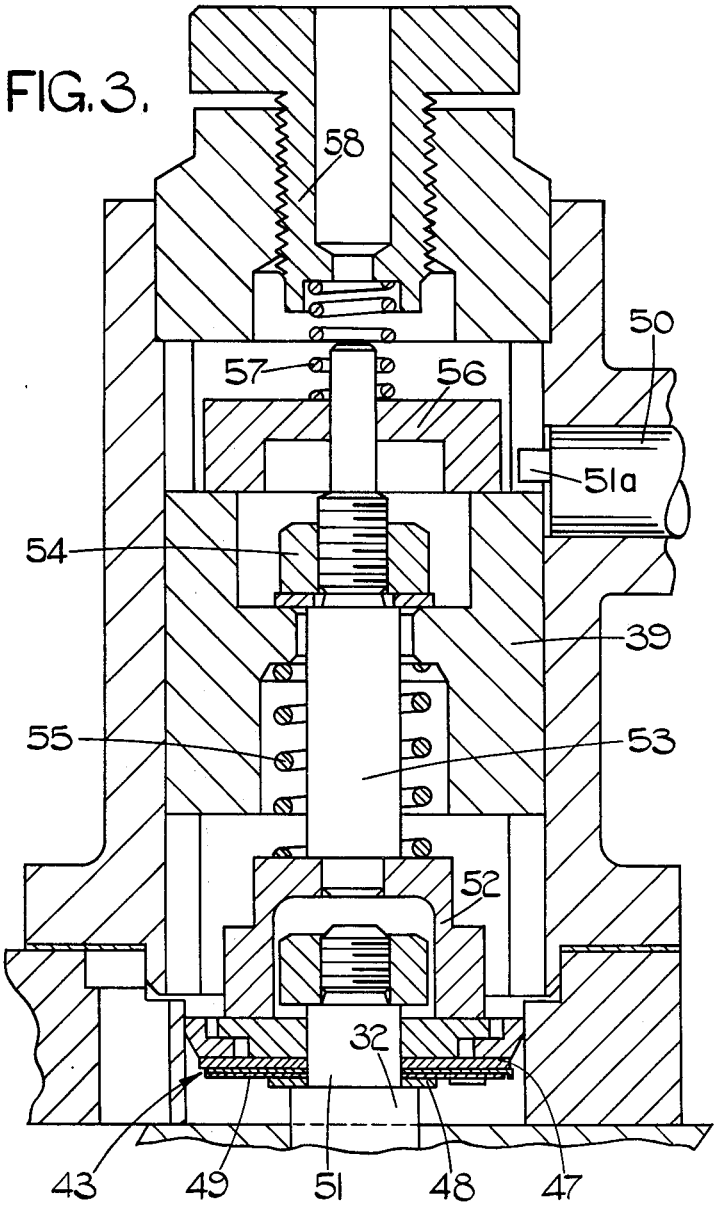

Turning now to FIG. 3 the piston 32 only part of which is shown is provided with a much shorter stem 51 than the stem of FIG. 2. The stem 51 again mounts a nut but this merely serves to abut against the dashpot piston 43. As in the previous example, the support plates 47 and 48 are provided and interposed between these plates is the bimetal member 49.

The dashpot piston 43 is engaged by the rim of a cup-shaped member 52, to which is secured a stem 53 which passes through the abutment 39.

The stem 53 has an intermediate threaded portion upon which is engaged a nut 54 which retains a washer against a step on the stem 53. The abutment 39 is urged into engagement with the washer by means of a main coiled compression spring 55. The spring 55 is in a preloaded condition when the nut 54 is tightened.

The extended portion of the stem 53 passes through an aperture in thhe base of a cup-shaped member 56 the rim of which engages the abutment 39. Moreover, interposed between the base wall of the member 56 is one end of an idling spring 57 the other end of which is located against a screw 58 forming an adjustor for the force exerted by the spring 57.

The adjustable member 50 is provided as in the example shown is FIG. 2, but the pin 51*a* when the member is set to the minimum speed position is clear of the abutment 39. At idling speeds, therefore, only the spring 57 opposes the force exerted by the fuel under pressure acting upon the piston 32. The abutment 39 is moved upwardly with the piston 32 as the idling speed increases and downwardly by the spring 57 as the idling speed falls, the bimetal member 49 works in exactly the same way as described with reference to FIG. 2. It will be appreciated that the setting of the screw 58 determines the force exerted by the spring 57 and therefore, determines the idling speed of the engine.

If the manually operable member 50 is moved angularly, then the clearance between the pin 51*a* and the abutment 39 is taken up and the latter is then moved downwardly such downward movement also being imported to the piston 32 so that an increase in the rate of fuel supplied to the engine is obtained. Since the spring 55 is preloaded, the piston will not move under the action of fuel pressure against the action of the spring 55 until the preload force of the spring is attained. Thus the member 50 can be moved angularly to directly control the rate of fuel supply to the engine and only when the force acting on the piston 32 is sufficient to compress the spring 55 will governing be obtained. Thus, the form of governor shown in FIG. 3 determines the idling speed of the engine and the maximum speed of the engine.

We claim:

1. A liquid fuel pumping apparatus for supplying fuel to an internal combustion engine and comprising an injection pump operable in use, in timed relationship with an associated engine, a feed pump for supplying fuel under pressure to the injection pump, valve means operable to control the outlet pressure of the feed pump in a manner so that it increases with speed, an adjustable throttle for varying the rate of fuel supply to the injection pump from the feed pump, a cylinder, a piston in said cylinder, conduit means through which one end of said cylinder communicates with the outlet of the feed pump so that one end of the piston is subject to said pressure, resilient means operable at low engine speeds to oppose movement of the piston by said pressure, the position of said piston determining the setting of the throttle, and a bimetal member responsive to the temperature within a housing part of the apparatus, the apparatus in use being mounted in close proximity to the engine so that the temperature within the housing part is representative of the temperature of the engine, said bimetal member being positioned between the piston and the resilient means so that the force generated by the fuel under pressure acting on the piston is transmitted to the resilient means through the bimetal member.

2. An apparatus according to claim 1 including co-operating port means on the piston and cylinder, said co-operating port means constituting said adjustable throttle.

3. An apparatus according to claim 2 including an extension is said piston, said resilient means comprising a pair of coiled compression springs located about said extension, an abutment on the extension and engaging one end of one spring, a movable part disposed between the springs and engaged by the other end of the one spring, the part being engaged by one end of the other spring, the other end of which acts on the piston through the bimetal member.

4. An apparatus according to claim 3 including operator adjustable means for varying the position of said part whereby the force exerted by said other spring can be varied.

5. An apparatus according to claim 4 including a dashpot piston slidable within a further cylinder, said dashpot piston being located about said extension and positioned between the other end of said other spring and said piston.

6. An apparatus according to claim 2 in which said resilient means comprises a coiled compression spring, and the apparatus including an abutment slidable within the housing, said spring acting between said abutment and a fixed part of the housing, a stem slidable in said abutment, a member mounted on said stem and bearing on said piston through said bimetal member, a pre-loaded spring acting between said abutment and said member and manually operable means for effecting movement of said abutment, said manually operable means when set at an engine idle position allowing movement of the piston and abutment against the action of said compression spring, said pre-loaded spring yielding under the force due to the fuel pressure acting on the piston to limit the maximum speed of the associated engine.

* * * * *